United States Patent [19]

Fougere

[11] Patent Number: 4,674,898

[45] Date of Patent: Jun. 23, 1987

[54] PRINTWHEEL

[75] Inventor: Richard J. Fougere, Marshfield, Mass.

[73] Assignee: The Fern Group, Inc., North Pembroke, Mass.

[21] Appl. No.: 668,192

[22] Filed: Nov. 5, 1984

[51] Int. Cl.[4] ..... B41J 1/22

[52] U.S. Cl. ..... 400/144.2; 501/1; 400/174; 400/462; 101/93.19

[58] Field of Search ..... 400/139, 140, 144, 144.1, 400/144.2, 174, 175, 452, 453, 456, 462, 469; 501/1; 101/93.19

[56] References Cited

U.S. PATENT DOCUMENTS

| | | | |
|---|---|---|---|
| 266,053 | 10/1882 | Sachs | 501/1 X |
| 690,210 | 12/1901 | Wagner | 400/452 X |
| 1,160,134 | 11/1915 | Briggs | 400/452 |
| 2,236,663 | 4/1941 | Adams | 197/53 |
| 3,063,541 | 11/1962 | Hartnett et al. | 400/469 |
| 3,434,867 | 3/1969 | Rousselot et al. | 400/174 X |
| 3,491,055 | 1/1970 | Talley | 501/1 X |
| 3,662,405 | 5/1972 | Bortz et al. | 501/1 X |
| 3,790,374 | 2/1974 | Dedek | 400/179 X |
| 3,848,722 | 11/1974 | Bolan et al. | 197/53 |
| 3,935,937 | 2/1976 | Tramposch | 400/174 |
| 3,952,397 | 4/1976 | Lohr | 400/174 X |
| 4,037,706 | 7/1977 | Sohl et al. | 197/54 |
| 4,124,930 | 11/1978 | Bauer | 29/407 |
| 4,126,400 | 11/1978 | Suzuki et al. | 400/144.2 |
| 4,127,336 | 11/1978 | Hiraoka et al. | 400/144.2 |
| 4,235,664 | 11/1980 | Menke | 400/144.2 X |
| 4,251,318 | 2/1981 | Oberg et al. | 400/144.2 X |
| 4,305,756 | 12/1981 | Wiech, Jr. | 75/211 |
| 4,375,779 | 3/1983 | Fischer | 501/1 X |
| 4,503,157 | 3/1985 | Hatahira | 501/1 |

FOREIGN PATENT DOCUMENTS

| | | | |
|---|---|---|---|
| 3214510 | 10/1983 | Fed. Rep. of Germany | 400/144.2 |
| 95573 | 7/1980 | Japan | 400/144.2 |
| 97957 | 7/1980 | Japan | 400/174 |
| 101455 | 8/1980 | Japan | 400/144.2 |
| 91273 | 6/1982 | Japan | 400/174 |
| 96862 | 6/1982 | Japan | 400/144.2 |
| 159657 | 10/1982 | Japan | 400/144.2 |
| 195662 | 12/1982 | Japan | 400/144.2 |
| 90963 | 5/1983 | Japan | 400/144.2 |
| 215362 | 12/1983 | Japan | 400/144.2 |
| 2027394 | 2/1980 | United Kingdom | 400/144.2 |

OTHER PUBLICATIONS

*Xerox Disc. Journal,* "Lamination Techniques for Fabrication of a Daisy Print Wheel", Muth, vol. 1, No. 5, May 1976, p. 43.

*IBM Disc. Journal,* "Low Inertia Impact Printer Print Wheel", Alexander et al., vol. 22, No. 4, Sep. 1979, pp. 1316–1317.

*Review of the Electrical Communication Laboratory,* "Development of Hard Metal Plated Plastic Type Wheel", Ishihara et al., vol. 18, Nos. 7–8, Jul.–Aug. 1970, pp. 575–588.

*Review of the Electrical Communication Laboratories,* "New Daisy Typehead Development for Teleprinters with Servo-Motor Drive", Hiraoka et al., vol. 27, Nos. 9–10, Sep.–Oct. 1979, pp. 849–863.

*Primary Examiner*—Edgar S. Burr
*Assistant Examiner*—James R. McDaniel
*Attorney, Agent, or Firm*—Lahive & Cockfield

[57] ABSTRACT

A printwheel for an impact printer includes a sheet metal core having a central disk portion and a plurality of radially extending arms. Sintered ceramic or metal character slugs are affixed to retaining regions at the ends of the respective character arms. A polymer film jackets the disk portion and adjacent regions of the character arms.

5 Claims, 4 Drawing Figures

PRINTWHEEL

BACKGROUND

This invention relates to printing devices, and more particularly to printwheels for impact printers.

Printwheels for use with impact printers have been available for many years. Sometimes referred to as a "daisy wheel", the printwheel is a disk-shaped element, having a annular disk central region surrounded by radially extending character arms. At its tip, each character arm includes a character "slug" having a print face bearing a raised reversed facsimile of a member of a host language character set. The sequence of character slugs about the printwheel circumference is generally determined by industry standard.

Within the impact printer, the printwheel typically is attached to a rotatable printwheel spindle. The end portion of a single character arm and the corresponding character slug are positioned between a striking element and an opposed platen with the print face being opposite the platen. A transfer medium (such as an inked ribbon) and a print medium (such as paper) are positioned between the print face of the printwheel and the platen. In operation, the printwheel spindle rotates, so that the character slugs successively pass before the striking element. Synchronously with the movement of the printwheel, the striking element, e.g., a hammer, is selectively activated when a desired character slug is before it, to strike the character arm, causing deflection of the character arm so that the print face drives the inked ribbon against the print medium and platen. The striking element then retracts and the character arm returns to its normal position. As a result of this operation, ink is transferred from the ribbon to the print medium, thereby forming the character image of the driven slug on the medium.

Conventional printwheels are often formed using metal coated phenolic structures. When such printwheels are used in conjunction with printers coupled to computers and word processors, the printwheels are typically subjected to repeated, high-speed striking. This use causes the printwheel character arms to become less resilient with use, resulting in degradation of performance. The repeated impacting of the character slugs additionally results in surface wear on the character slug print face causing loss of print character crispness. Consequently, conventional printwheels must be replaced at a relatively high frequency in order to maintain acceptable printing performance.

The object of this invention is to provide an improved printwheel with long lasting character slug sharpness and character arm resiliance.

A further object of the invention is also to provide a lightweight print wheel with improved vibration damping characteristics.

SUMMARY OF THE INVENTION

In one broad aspect, the invention provides a printwheel comprising a sheet metal core member having a substantially planar central disk portion and elongate, resilient, radially-extending arms. Each arm includes a character slug retaining region at its distal tip. The retaining region includes a passage therethrough. A sintered character slug is disposed about the tip of each character arm, with a portion of the slug lying within the retaining region passage.

In another broad aspect, the invention provides a printwheel comprising a core member having a substantially planar central disk portion and a plurality of elongate, resilient, radially-extending arms. A character slug is positioned on the distal tip of each of the arm, while a polymeric film jackets the central disk and adjacent regions of the character arms.

In various forms of the invention, the character slug may be formed from sintered ceramic material or from sintered powdered metal which is fused to the character arm retaining region.

Other aspects of the invention are evident in the description and claims which follow.

BRIEF DESCRIPTION OF THE ILLUSTRATIONS

The foregoing and other objects of this invention, the various features thereof, as well as the invention itself, may be more fully understood from the following description, when read together with the accompanying drawing in which.

DETAILED DESCRIPTION OF THE PREFERRED EMBODIMENT

Figure 1:
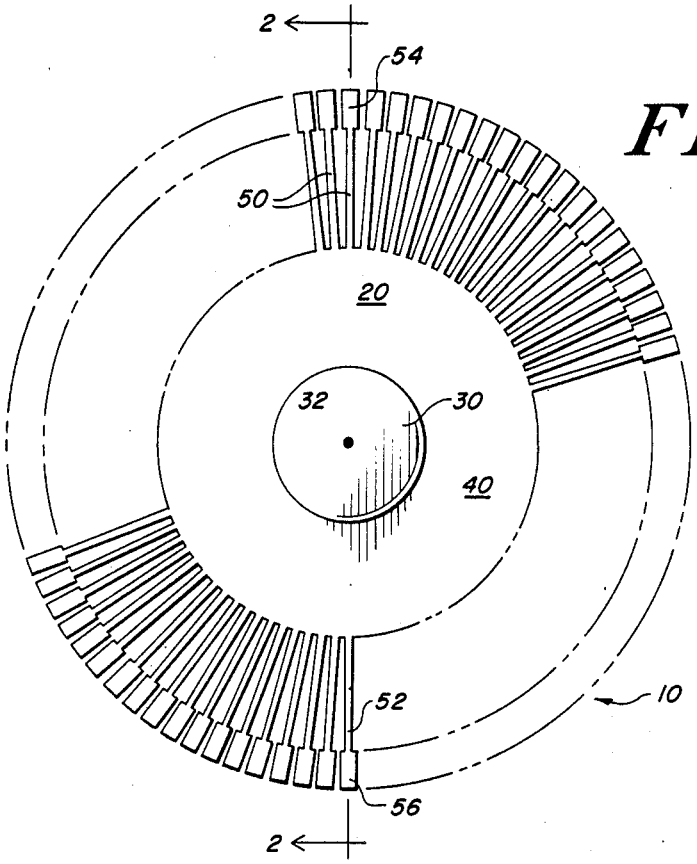
FIG. 1 shows a top elevation view of a printwheel according to the preferred embodiment of the invention.

FIG. 1 shows a printwheel 10 according to the preferred embodiment of the invention. Printwheel 10 comprises a sheet metal core member 20 and a mounting hub 30. The printwheel 10 is generally symetrical about a central axis 32. Core member 20 includes a central annular disk portion 40 and a plurality of radically extending character arms. (Only two arms 50 and 52 are marked with a reference designations in FIG. 1). In the preferred embodiment, the core member 20 is formed from 0.004 inches thick, chemically milled, or etched, sheet steel. The character arms are 1.110 inches in length and 0.030 inches wide and the overall diameter of the printwheel is 3.1 inches. In alternate embodiments, the sheet steel core member may have thickness in the range 0.003 to 0.010 inches.

Each character arm has a character slug at its distal tip, that is, at the periphery of the printwheel. The specific number of character arms may vary for various forms of the invention. By way of example, a printwheel intended for standard English language printing typically has 96 arms. Preferrably, the character arms are uniformly distributed about the central axis 32 of the central disk portion 40.

The character slugs are each positioned over a retaining region at the end of an associated character arm. Only two character slugs 54 and 56 are marked with reference designations in FIG. 1. Each character slug includes a print face on one side or core member 20 and a striking area of the other side. Each print face generally includes a raised facsimile of a reversed character in a language character set associated with the printwheel. In instances where, for purposes of standardization and ease in fabrication, there are more character arms than members of the language character set, numerous character arms may represent the blank character. In the preferred embodiment, the circumferential sequencing of the character slugs about the central disk portion is in accord with industry standards.

Figure 2:
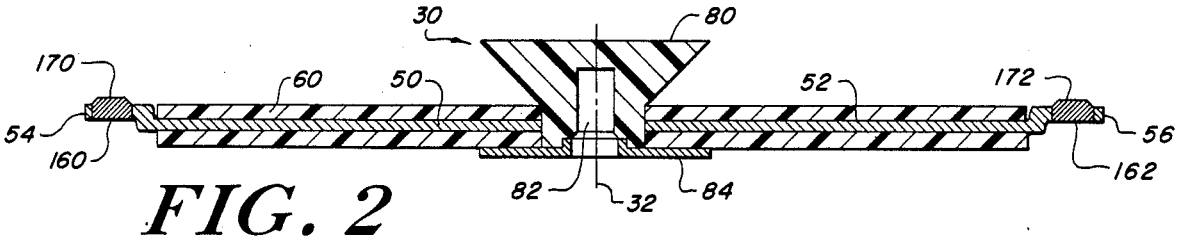
FIG. 2 shows a side elevation view of the printwheel of FIG. 1.

FIG. 2 shows a cross-sectional view of the printwheel 10, where elements in FIG. 2 corresponding to elements in FIG. 1 are represented with the same reference designations. The central disk portion and character arms of the core member 20 are not separately identified in the FIG. 2.

In the preferred embodiment, a polymer film 60 encapsulates the disk portion 40 of the core member 20, as well as the adjacent portions of the character arms. The coating 60 provides a desired resiliency and stiffness to the character arms and in addition serves to damp vibrations at the printwheel. In alternate embodiments, these functions may be provided by an external disk element affixed to one side of the printwheel. In the preferred embodiment, the polymer film is a polycarbonate resin which jackets the entire core member, excepting the regions underlying the character slug. Alternatively, the film may encapsulate a lesser portion of the character arms. In the preferred embodiment, the film thickness is 0.035 inches, although polycarbonate resin film thicknesses in the range from 0.006 to 0.080 inches are also suitable.

The hub 30 is centered within central disk portion 40 about axis 32. Hub 30 provides a means for coupling the printwheel to the spindle of the impact printer, as well as assists in damping vibrations at the printwheel. In the present embodiment, the hub is composed of an elastomer, and specifically of Buna-N manufactured by duPont. The hub 30 includes a grasping section 80, an insert section 82 and a disk-shaped base section 84. Section 30 is shaped generally as a truncated cone, and is positioned over one side of print wheel 10. Insert section 82 is disposed within a mounting passage along the central axis 32 of disk portion 40. The base section 84 lies against the underside of the central disk portion 40. An axially-oriented, centered passage in the hub 30 runs through the base and insert sections, and partially through the grasping region 80, to permit coupling of the printwheel 10 to the printer spindle.

FIG. 2 shows in detail the strike areas 160 and 162 and print faces 170 and 172 of character slugs 54 and 56, respectively. While the strike areas in the present embodiment are on one side of the character slugs, in alternate embodiments the strike areas may lie on the character arms closer to the central axis 32 of the print wheel.

Figure 3:
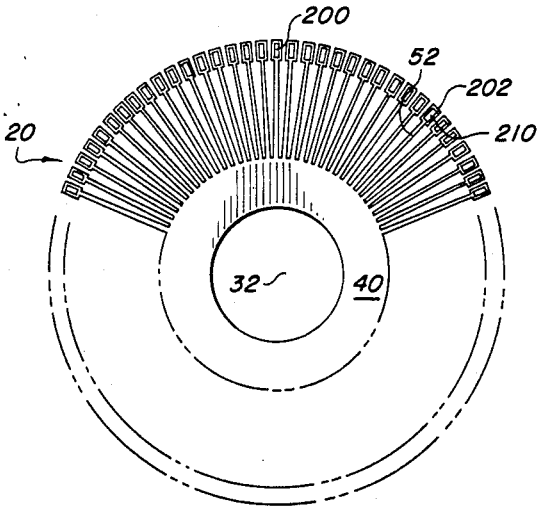
FIG. 3 shows a top elevation view of the sheet metal core member of the embodiment of FIG. 1.
Figure 4:
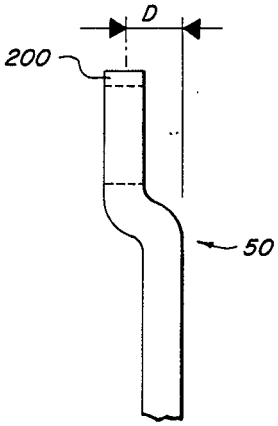
FIG. 4 shows a side elevation view of one character arm of the core member of FIG. 3.

FIG. 3 shows the sheet metal core member 20 in preferred embodiment of the invention. FIG. 4 shows a side elevation view of the character arm 50 of core member 20. As shown, core member 20 is a skeletal structure for the print wheel, and comprises three distinct areas: central annular disk portion 20, character arms (two being identified by reference designations 50 and 52 in FIG. 3), and character retaining regions (two of which are identified by reference designations 200 and 202 in FIG. 3). With each arm being an elongate section with one end joining central area 20 and the other joining a character retaining region. Each of the retaining regions includes a rectangular-shaped central hole, or passage, passing therethrough, exemplified by hole 210 as denoted in FIG. 3. The retaining areas are offset from the plane of portion 20 by a distance D (equal to 0.015 inches in the preferred embodiment). Chemical milling is the preferred method of forming the base member 20 though other techniques, e.g., stamping may be employed. The displacement D for the retaining regions can range from zero to one half the thickness of the arm and may be established by stamping.

The retaining regions lie at the distal ends of the character arms and are generally rectangular in shape. Other retaining area geometries, such as cylindrical, are also within the scope of the invention. The passage through the character retaining regions provide mechanical support for character slugs during both fabrication and operational use.

In accordance with the present invention, each character slug is sintered. By way of example, the slug may be sintered ceramic material or sintered powdered metal. In the latter case, the sintered slug may be fused to the core member 20 for greatest strength and durability. The slugs may be sintered using conventional techniques such as those described in U.S. Pat. No. 4,305,756. More particularly, the slugs are initially injection molded about the respective retaining regions forming green bodies (i.e., a mixture of powdered metal or ceramic materials with polymer and wax binders). Thereafter, the green bodies are processed in an oven to yield the sintered character slugs.

The sintered character slugs particularly include portions within the passage of the respective retaining region to establish high retention to the core member. In the case of the powdered metal character slugs, the slugs also are fused to the core member surface to establish yet a higher degree of retention and mechanical support.

In operation, the impact printer striking element applies a force (in the dirction of axis 32) to the strike area of a character slug. In response to this force, the arm supporting that slug deflects, forcing the print face against the transfer medium, the print medium and the platen.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A printwheel for an impact printer, comprising:

A. a sheet metal core member having a substantially planar central disk portion and a plurality of sheet metal elongate, resilient arm portions extending radially therefrom, each of said arm portions including a character slug retaining region at its distal tip, said retaining region including a passage extending completely therethrough, B. a plurality of sintered character slugs, each of said character slugs being disposed about an associated one of said retaining regions and including a portion filling said passage of said retaining region wherein each of said character slugs is metallic and is sintered to said associated retaining region, and further comprising a polymer film disposed about said disk portion and the majority of said arm portions.

2. A printwheel according to claim 1 wherein said core member is chemically milled sheet steel having thickness in the range 0.003 to 0.010 inches.

3. A printwheel according to claim 1 wherein said polymer film is a polycarbonate resin.

4. A printwheel according to claim 3 wherein said core member is chemically milled steel having thickness in the range 0.003 to 0.010 inches and said film has thickness in the range 0.006 to 0.080 inches.

5. A printwheel according to claim 3 or 4 wherein said disk portion includes a mounting hole disposed about its principal axis, and further comprising an elastomeric hub member coupled to said polymer film, said hub member being symmetrically disposed about said principal axis and being adapted for coupling to said impact printer.

* * * * *